United States Patent [19]

Muller

[11] 4,086,145

[45] Apr. 25, 1978

[54] COKE OVEN DOOR LINING

[75] Inventor: Joseph M. Muller, Edgeworth, Pa.

[73] Assignee: Jones & Laughlin Steel Corporation, Pittsburgh, Pa.

[21] Appl. No.: 777,258

[22] Filed: Mar. 14, 1977

[51] Int. Cl.[2] ..... C10B 25/06

[52] U.S. Cl. ..... 202/248; 110/173 R

[58] Field of Search ..... 202/248; 110/173 R

[56] References Cited

U.S. PATENT DOCUMENTS

| | | | |
|---|---|---|---|
| 2,308,999 | 1/1943 | Moore | 202/248 |
| 2,853,347 | 10/1958 | Cellan-Jones | 202/248 |
| 2,993,845 | 7/1961 | Coe | 202/248 |

FOREIGN PATENT DOCUMENTS

| | | | |
|---|---|---|---|
| 677,834 | 12/1929 | France | 202/248 |
| 569,724 | 12/1933 | Germany | 202/248 |
| 513,594 | 12/1930 | Germany | 202/248 |
| 475 of | 1906 | United Kingdom | 202/248 |
| 8,414 of | 1898 | United Kingdom | 202/248 |

*Primary Examiner*—Morris O. Wolk
*Assistant Examiner*—Roger F. Phillips
*Attorney, Agent, or Firm*—Gerald K. White; T. A. Zalenski

[57] ABSTRACT

A coke oven door lining assembly involving a vented, metallic door lining having barrier and support means serves to lower coke oven gas pressure at the door sealing edges and thereby reduce emissions. The lining may be open or closed along its length. Other advantages of the assembly involve reduced maintenance, simplicity of manufacture, and minimization of the occurrence of dense, hard to remove carbonaceous deposits on the lining.

9 Claims, 10 Drawing Figures

COKE OVEN DOOR LINING

The invention generally pertains to an improved coke oven door lining assembly which involves the use of a vented metallic lining that may be open or closed along its length. A barrier portion of the door lining serves to prevent coal and coke in the oven from piling against the coke oven doors. The barrier extends approximately from top to bottom and side to side of the coke oven interior and is spaced apart a sufficient distance from the door for coke oven gases to easily pass through the collector main. This permits oven pressures to be reduced in the vicinity of the door seal edges as the coking process proceeds with a resultant reduction in the tendency for coke oven gas to leak out of the door.

Commercially utilized coke oven doors typically employ solid ceramic door linings for the purpose of insulating the steel components of the door from heat generated during the cokemaking process. A lining of this nature is illustrated in U.S. Pat. No. 2,778,784. However, it is generally known that ceramic door linings can be constructed with central openings that function to vent coke oven gases from the bottom to the top of the coke oven interior in the area of the doors for the purpose of reducing the gas pressure at the seal edges. Linings of this nature are discussed in *Coke & Gas,* Volume 15, pages 221 and 222, 1953 and in *Ironmaking Proceedings AIME*, Vol. 33, pages 391–396, 1974. Finally, a metal lining similar in design to a solid ceramic lining for coke oven doors is described in U.S. Pat. No. 2,993,845. Such solid metal lining, however, does not provide the advantages found in the open, vented metal lining of the invention. For various reasons, none of the above described lining systems has proven to be completely satisfactory.

The basic objectives of the invention are to provide a coke oven door lining assembly capable of eliminating the leakage used by carbonaceous depositions on ceramic door linings and to greatly reduce the gas pressure during coking that the door must seal in the oven so as to minimize emissions. It is a further objective to provide a door lining assembly that is capable of withstanding the harsh environment of a coke oven and yet also provide reduced coke oven emissions and simplified maintenance.

These and other objectives and advantages will become apparent to those skilled in the art from the following description of the invention.

FIG. 1 is a horizontal cross-sectional view of an embodiment of the coke oven door liner assembly of the invention having a support I-beam.

FIGS. 2, 3, and 4 are isometric views of the assembly of FIG. 1. FIG. 2 is a coke side door lining and FIGS. 3 and 4 are embodiments of pusher side door linings.

FIG. 6 is a coke side door lining and FIG. 7 is a pusher side door lining.

FIG. 9 is a coke side door lining and FIG. 10 is a pusher side door lining.

The use of a solid ceramic coke oven door lining can result in the build-up of heavy carbonaceous deposits on the door lining adjacent to the oven walls to such extent that the door cannot be properly fitted into the oven opening or the door latches cannot be tightened sufficiently to prevent emissions. At times, coke oven gas leakage along the sealing edges of the door can be of sufficient magnitude to cause its ignition and thereby cause damage to the steelwork holding the coke oven battery brickwork together. When such fires occur, quenching is required with resultant structural damage to the door, jambs, etc. Cleaning the carbonaceous deposit from the door lining requires removing the entire door from the oven with the use of heavy machinery and then transporting it to the end of coke oven battery where pneumatic chisels and intensive labor in limited work areas at the battery ends are required to remove the carbonaceous material. In addition, heating and cooling of the ceramic lining impregnated with carbonaceous material leads to the early failure of the lining.

With the advent of the commercialization of pipeline charging in which coke ovens are charged with preheated coal that passes through pipelines into the coke oven, problems associated with carbon build-up on ceramic door linings have accentuated. Moreover, relatively more massive door lining carbonaceous deposition has occurred when ovens are pipeline charged when the flow of coal is directed directly to the oven floor instead of at an angle to the floor. Apparently the carbonaceous deposition is related to differences in the coal distribution in the oven resulting from the mode of charging and caused by tar vapors liberated from the coal during coking. The tar vapors deposit on the ceramic lining and are then coked by the heat from the oven walls into a very hard dense carbonaceous form.

It has been discovered that the detrimental effects of carbonaceous build-ups are minimized through the use of doors of the type embodied in the invention. Carbonaceous deposits on the metal lining are, for the most part, light and fluffy in composition, easily removed, and do not interfere with door latching. Accordingly, full latch force may be exerted against the sealing edges because the area adjacent to the coke oven walls is open rather than blocked with carbonaceous deposits. Such light, fluffy deposits may be easily removed from the door liner in a matter of several minutes through simple manual scraping. This procedure is clearly advantageous to that required for ceramic door liners as cleaning is accomplished without the need to remove the door to off-battery locations. On the other hand, the carbonaceous deposits on ceramic linings are hard and dense. Such linings require frequent cleaning because of the relatively limited space between the ceramic lining and the oven wall limits the amount of deposits that can be tolerated.

Figure 1:
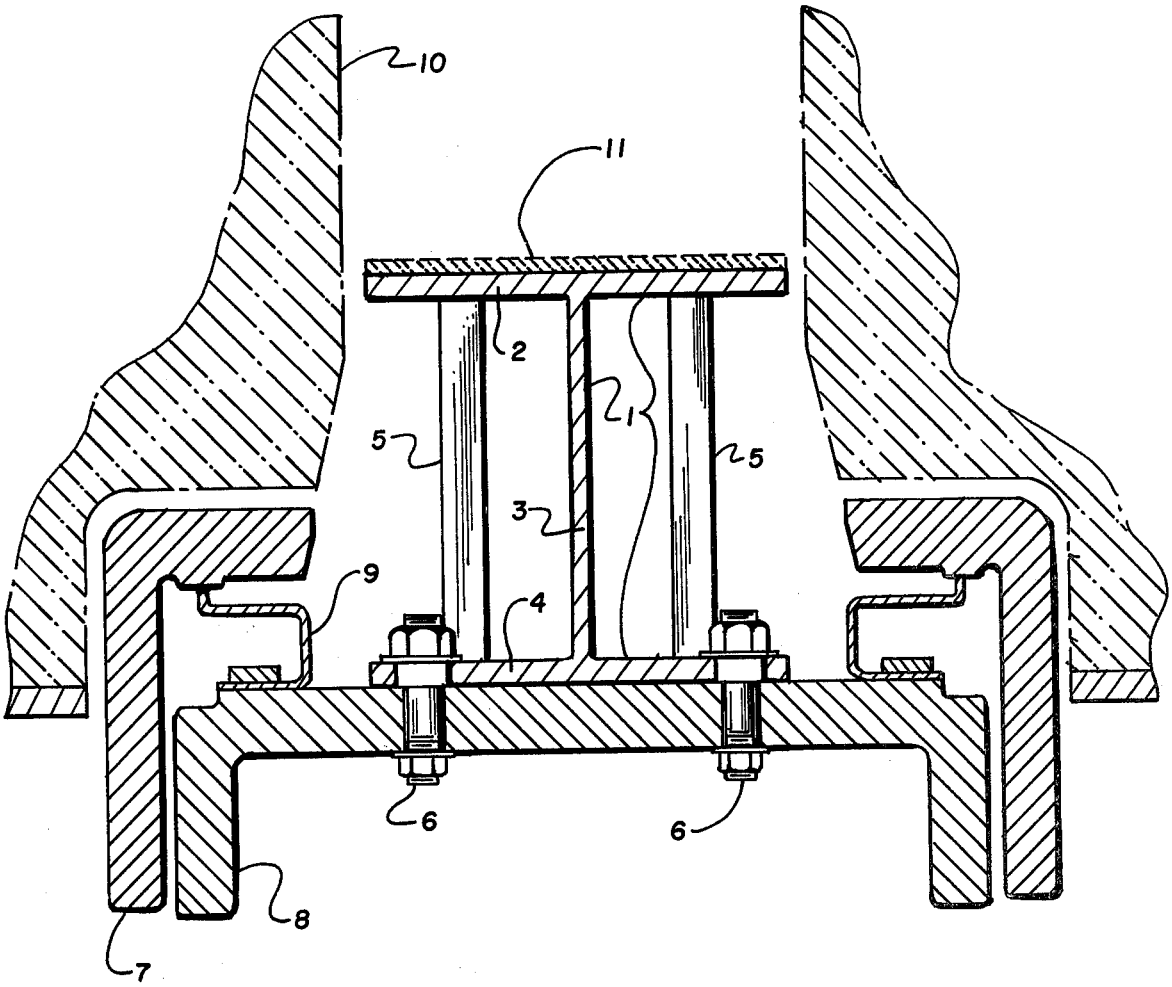

FIG. 1 illustrates a horizontal cross-sectional view of a preferred embodiment of the coke oven door liner assembly of the invention. In this view, I-beam 1 is a metallic door lining and functions both as a barrier and as means to support and maintain the barrier in a substantially rigid position that is spaced apart from the coke oven door frame 8 and oven sidewalls 10. I-beam 1 is preferably made from steel due to reasons of economics but may be composed of other heat resistant metals or composites thereof. Outer flange portion 2 of I-beam 1 serves as a generally flat barrier for preventing coal and coke from piling against the interior of the coke oven door and thus preventing coke oven gas generated during the cokemaking process from easily rising to the top of the coke oven interior and then being drawn off by the collector main. Outer flange or barrier 2 has a length and width sufficient to substantially prevent coal from collecting or piling against coke oven door frame 8 and impeding the rise of coke oven gas. I-beam 1 is connected to coke oven door frame 8 by bolts 6 which attach inner flange 4 of I-beam 1 to door frame 8.

Web 3 of I-beam 1 serves to support and maintain outer flange barrier 2 in a substantially rigid position. In addition said web 3 is of a nature that the support means do not essentially obstruct the space between barrier 2, door jambs 7, sealing members 9, and door frame 8. Insulating layer 11 may optionally be placed along or across the length of outer flange barrier 2 for purposes of reducing the amount of heat transmitted to barrier 2. The insulating layer may comprise any commonly available material and may be applied in solid or slurry form. In addition to web 3, it is preferred to further support and maintain barrier 2 with use of metal support rods 5 so as to further prevent movement that may be caused by the weight of coal, the pressure of the coke, and the heat encountered in the cokemaking process.

Figure 2:
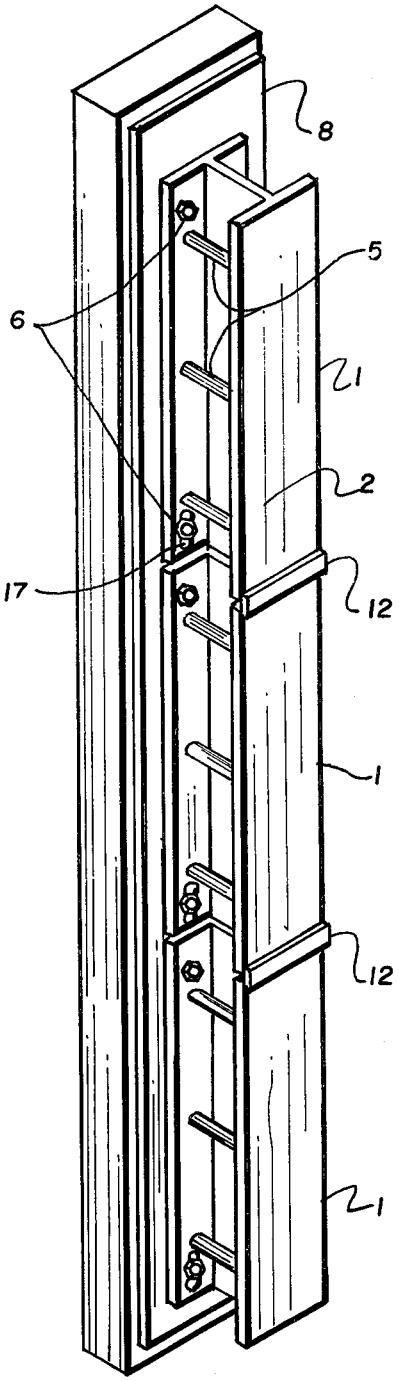

FIG. 2 illustrates a full isometric view of the coke oven door lining described in FIG. 1. Shields 12 which are welded at the top, cover the expansion space between the separate sections of steel beams. The use of separate sections is preferred so as to minimize liner warpage. Bolt slots 17 for bolt 6 are provided at the bottom of beam section to permit thermal expansion of the beam. Top bolts 6 of each beam 1 should be adjusted to be firm tight while bottom bolts 6 in slot 17 should be adjusted to be hand tight so as to permit movement of the beam.

Figure 3:
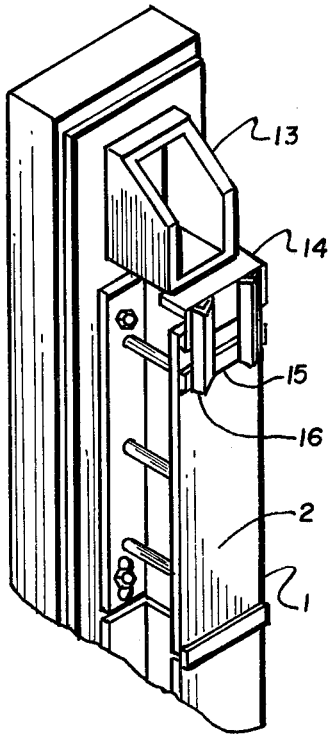

FIG. 3 is an isometric section of a top portion of a pusher side door of the type described in FIG. 1. Of particular note is manner in which angle 14 closes the gap between beam 1 and chuck door casting 13 to prevent coal from falling behind or inside of barrier 2 during the leveling operation. Angle 14 and bar 15 are welded to beam 1 and angles 16 are welded to angle 14 and bar 15 to provide strength and prevent distortion.

Figure 4:
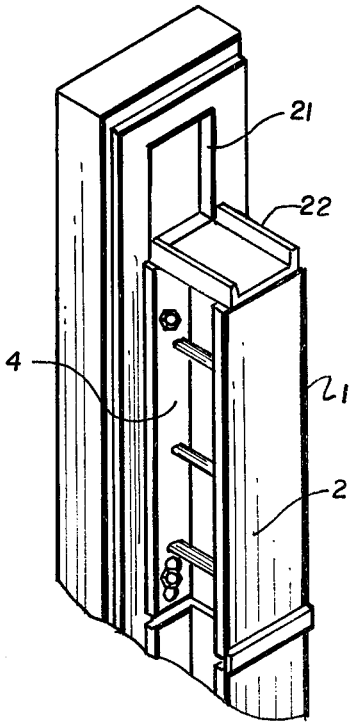

FIG. 4 is an isometric view of the top portion of another embodiment of a pusher side lining of the type described in FIG. 1. Channel 22 prevents coal from falling behind or inside of barrier 2 when the coal is leveled in the oven with use of a leveler bar inserted through chuck door opening 21. Channel 22 is welded to outer flange 2 and inner flange 4 of beam 1.

Figure 5:
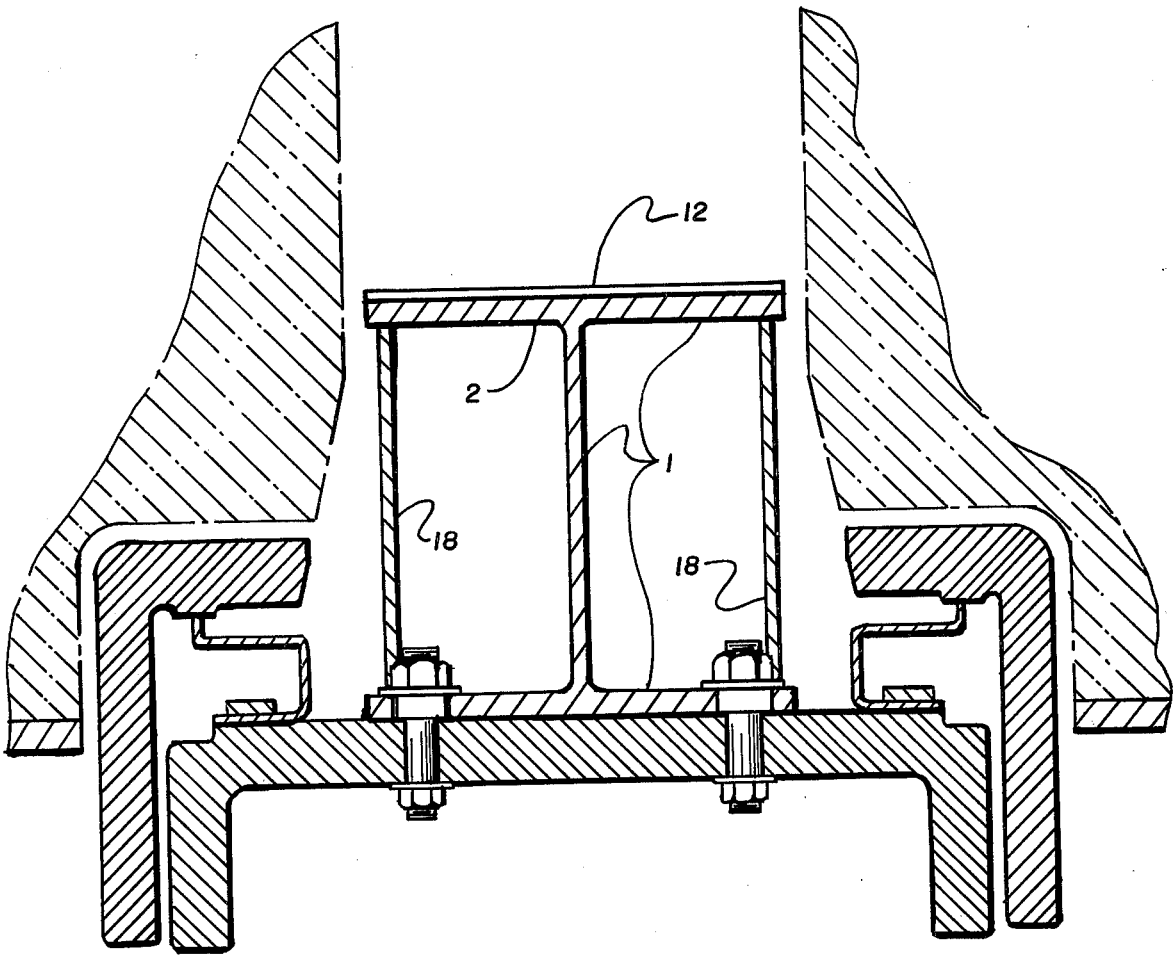
FIG. 5 is a horizontal cross-sectional view of an embodiment of the door liner assembly of the invention having side enclosure members.

FIG. 5 represents a horizontal cross-sectional view of another embodiment of the coke oven door liner of the invention. This embodiment is similar to that illustrated in FIG. 1 except that side enclosure members 18 which substantially extend the length of the door lining are used to enclose the beam and provide support for outer flange 2. This door lining functions as a closed vented lining preventing coal or coke from accumulating behind barrier 2 and thus providing an open gas passage.

Figure 6:
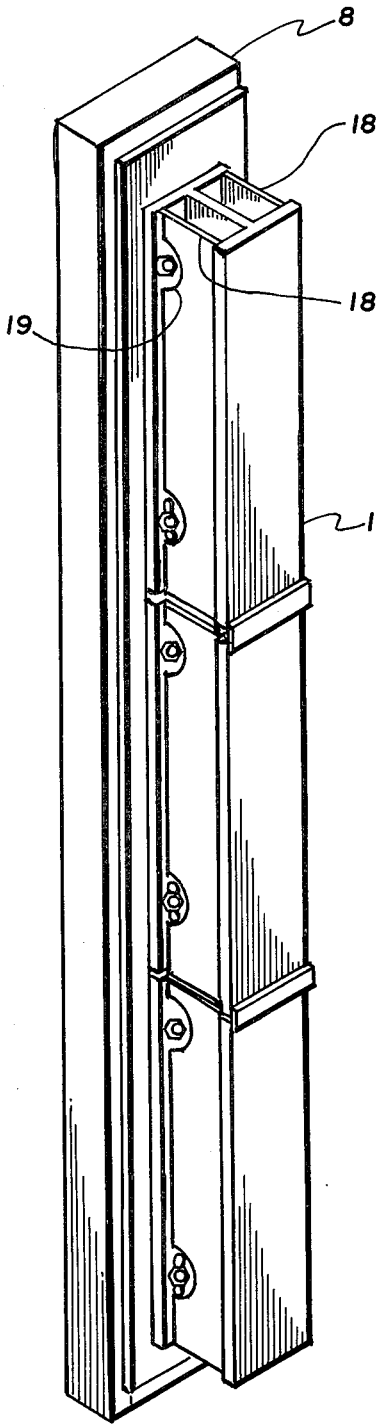

FIG. 6 represents an isometric view of the type of coke side door described in FIG. 5 and illustrates that side enclosure members 18 are welded to barrier 2 and inner flange 4. Slots 19 are cut in each enclosure to provide access to loosen and tighten bolts 6 which hold the lining to door frame 8.

Figure 7:
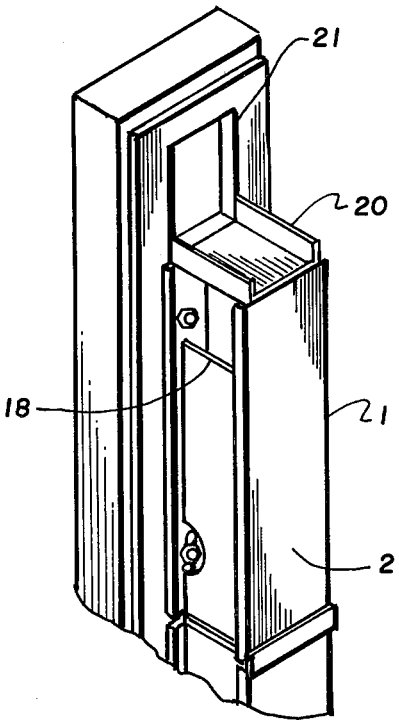
FIGS. 6 and 7 are isometric views of the assembly of FIG. 5.

FIG. 7 is an isometric view of a pusher side door of the type described in FIG. 5. Channel 20 is welded across the top of beam 1. An opening at the top of side enclosure 18 permits the gases to travel from the liner interior to the oven tunnel head and then to the collection main.

Figure 8:
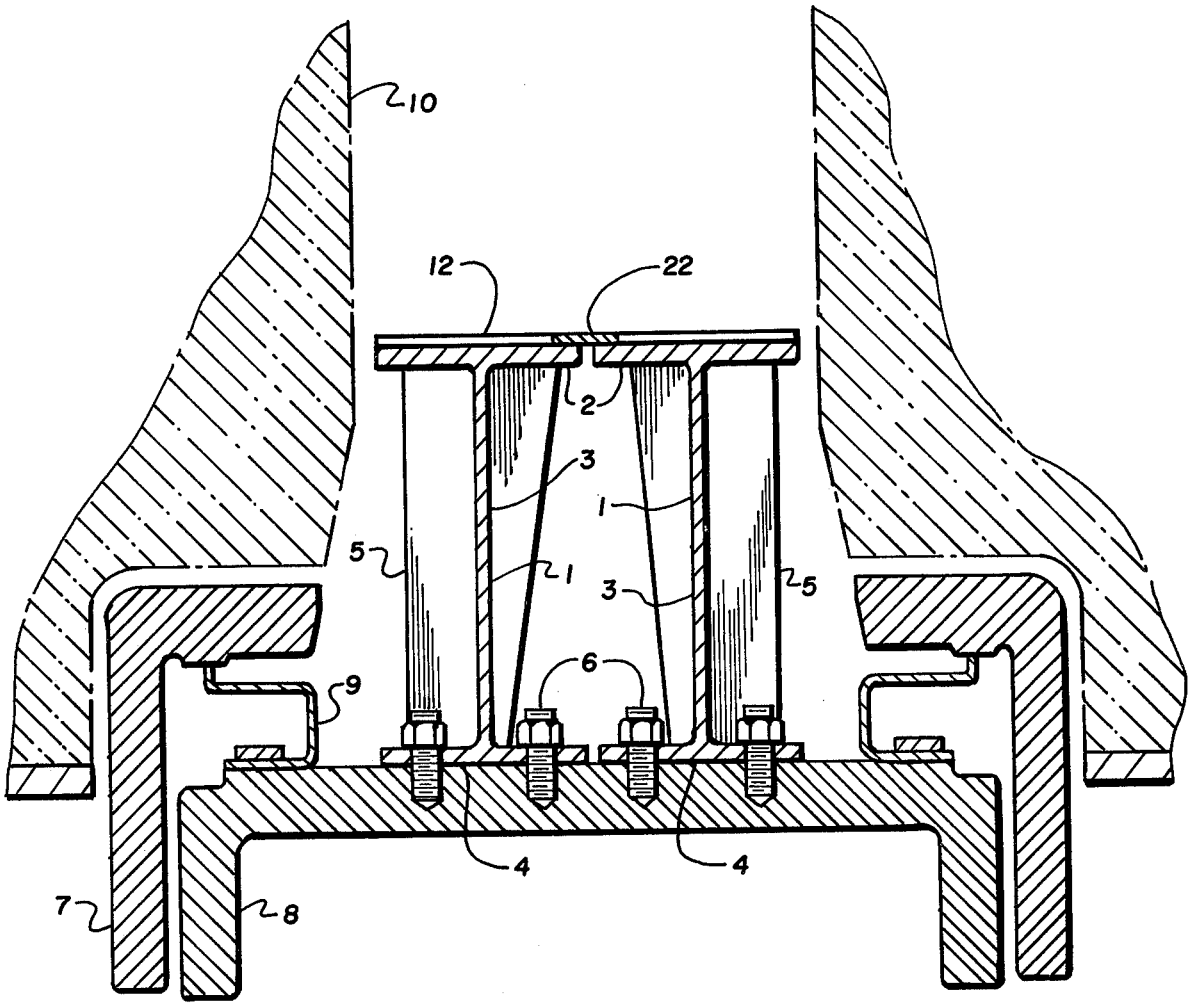
FIG. 8 is a horizontal cross-sectional view of an embodiment of the door lining assembly of the invention having a plurality of I-beam members.

FIG. 8 is a horizontal cross-sectional view of another embodiment of the coke oven door liner of the invention. This embodiment is the same as that shown in FIG. 1 except that two smaller and generally parallel I-beams are utilized. When two such I-beams are utilized, it may be advantageous to weld or otherwise attach closure 22 across the gap created between barriers 2 of each beam and to place closure 12 across the gap between barrier 2 of beams. Closures 12 and 22 are preferably only welded to one of the beams and overlap the other beam. This arrangement provides for freedom for expansion and contraction. The enclosures further ensure that coal cannot accumulate behind the respective barriers. Barrier 2 and inner flange 4 are preferably further supported in position by welding steel bars 5 between the two members at appropriate distances.

Figure 9:
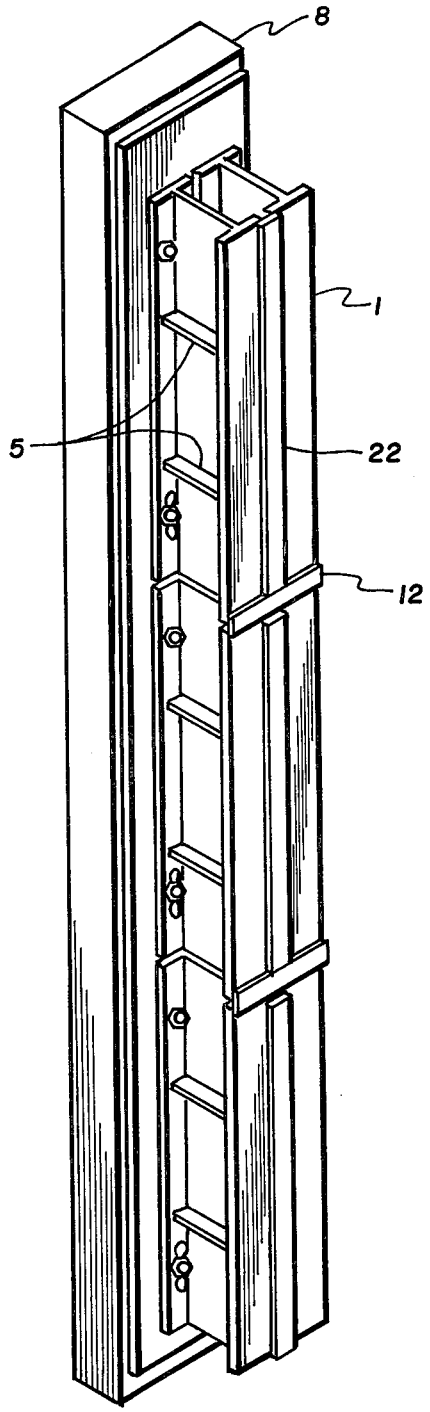

FIG. 9 is an isometric view of a coke side door described in FIG. 8.

Figure 10:
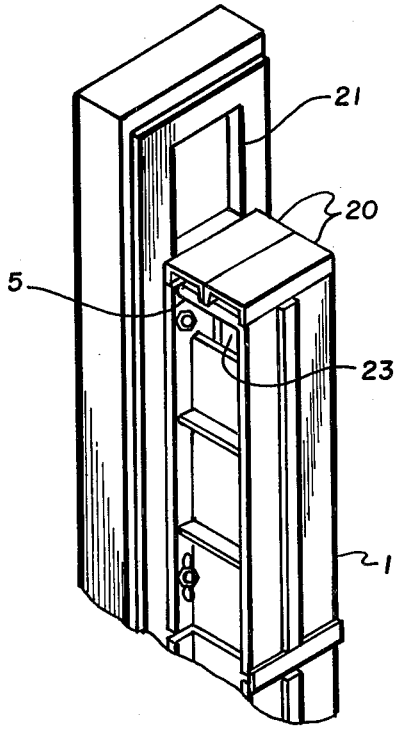
FIGS. 9 and 10 are isometric views of the assembly of FIG. 8.

FIG. 10 represents an isometric section of a pusher side door described in FIG. 8. Channels 20 are welded across the top of the two beams 1 and to a support bar. Opening 23 is created through removal of a portion of the web of beam 1 to permit the gases to pass from the door liner interior between beams 1 to the oven tunnel head.

As may be seen from several of the figures, the coke oven liner may also include a top portion or cover used on the pusher side door to prevent coal spillage into the lining interior during the leveling operation. Such top cover also may function to impede gas flow through the liner and thus, for the embodiments represented by FIGS. 7 and 10, a side opening is preferred so as to facilitate gas flow through the liner and into the oven tunnel head portion of the oven.

I claim:

1. A vented metallic coke oven door lining assembly, connected to a coke oven door frame comprising:

a metallic, generally flat barrier for preventing coal and coke from piling against said coke oven door frame and thereby preventing coke oven gas from easily rising to the top of the coke oven, said barrier having a length sufficient to extend approximately from top to bottom of a coke oven interior, a width sufficient to extend approximately from one coke oven sidewall to the other, and spaced apart a sufficient distance from and generally parallel to said coke oven door to permit coke oven gases to rise essentially unimpeded upwardly between said barrier and said coke oven door for supporting and maintaining said barrier in position; said support means not essentially obstructing the space between the barrier and coke oven door so as to enable coke oven gases to pass essentially unimpeded upwardly through said space and to thereby lower the gas pressure in the oven interior at the coke oven door location and to reduce the tendency of coke oven gases to leak from the coke oven interior.

2. The vented metallic coke oven door lining assembly of claim 1, wherein:

said metallic barrier and support means comprise at least one I-beam, having an outer flange portion serving as said barrier, a web serving as said support means, and an inner flange connected to said coke oven door frame.

3. The vented metallic coke oven door lining assembly of claim 2, wherein:

said support means further includes support rods connected to and spaced between said flanges of said I-beam so as to minimize warpage of said I-beam during heating and cooling cycles during cokemaking.

4. The vented metallic coke oven door lining assembly of claim 2, wherein:

said metallic door lining further comprises side enclosure members substantially extending the length of the door lining and attached to said I-beam near the ends of and spaced between its respective flanges.

5. The vented metallic coke oven door lining assembly of claim 2, wherein:

said metallic door lining comprises a plurality of I-beams.

6. The vented metallic coke oven door lining assembly of claim 1, wherein:

said barrier is coated with a heat-resistant material on its side adjacent to said coal and coke.

7. The vented metallic coke oven door lining assembly of claim 1 in combination with a coke oven.

8. The vented metallic coke oven door lining assembly of claim 4 which further includes:

a cover member located at the top of said metallic door lining for preventing spillage of coal and coke into said space between the barrier and coke oven door and an opening in at least one side enclosure member to facilitate the flow of coke oven gases exiting from said door liner.

9. The vented metallic coke oven door lining assembly of claim 5 which further includes:

a cover member located at the top of said metallic door lining for preventing spillage of coal and coke into said space between the barrier and coke oven door and an opening in at least one I-beam web so as to facilitate the flow of coke oven gases exiting from said door liner.

* * * * *

UNITED STATES PATENT OFFICE

CERTIFICATE OF CORRECTION

Patent No. 4,086,145 Dated April 25, 1978

Inventor(s) Joseph M. Muller

It is certified that error appears in the above-identified patent and that said Letters Patent are hereby corrected as shown below:

| | |
|---|---|
| Column 1, line 12: | insert after "pass" --between the barrier and door and then pass from the oven--; |
| Column 1, line 40: | "used" should be deleted and replaced by --caused--; |
| Column 1, line 53: | "support" should be deleted and replaced by --supported-- and |
| Claim 1, line 53: | insert after "for" --collection at the top of said coke oven; and support means connected to said barrier and to said coke oven door for--. |

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*